United States Patent [19]

Okazaki et al.

[11] Patent Number: 4,763,629

[45] Date of Patent: Aug. 16, 1988

[54] AIR-FUEL RADIO CONTROL SYSTEM FOR ENGINE

[75] Inventors: Katsumi Okazaki; Katsuhiko Yokooku; Tomomi Watanabe; Tadataka Nakazumi; Kiyotaka Mamiya, all of Hiroshima, Japan

[73] Assignee: Mazda Motor Corporation, Japan

[21] Appl. No.: 14,266

[22] Filed: Feb. 12, 1987

[30] Foreign Application Priority Data

Feb. 14, 1986 [JP] Japan ..... 61-30196
Feb. 17, 1986 [JP] Japan ..... 61-32590

[51] Int. Cl.[4] ..... F02M 17/00

[52] U.S. Cl. ..... 123/489; 123/480; 123/440

[58] Field of Search ..... 123/489, 440, 480

[56] References Cited

U.S. PATENT DOCUMENTS

| | | | |
|---|---|---|---|
| 4,542,730 | 9/1985 | Nagusawa et al. | 123/489 |
| 4,570,599 | 2/1986 | Hasegawa et al. | 123/489 |
| 4,598,684 | 7/1986 | Kato et al. | 123/489 |
| 4,602,601 | 7/1986 | Kanai | 123/489 |
| 4,616,619 | 10/1986 | Saito et al. | 123/489 |
| 4,640,257 | 2/1987 | Kodama et al. | 123/489 |
| 4,644,921 | 2/1987 | Kobayashi et al. | 123/489 |
| 4,648,370 | 3/1987 | Kobayashi et al. | 123/489 |
| 4,651,700 | 3/1987 | Kobayashi et al. | 123/489 |
| 4,664,087 | 5/1987 | Hamburg | 123/489 |

FOREIGN PATENT DOCUMENTS 59-208141 11/1984 Japan .

OTHER PUBLICATIONS

U.S. Patent Application Serial Nos. 772,440; 781,998; 813,933; 846,946 and 904,622 (Assignee: Mazda Motor Coporation).

*Primary Examiner*—Raymond A. Nelli
*Attorney, Agent, or Firm*—Gerald J. Ferguson, Jr.

[57] ABSTRACT

An air-fuel ratio control system for an engine in which a fuel injection amount is calculated according to the engine operating conditions and is corrected according to the output of an air-fuel ratio sensor, comprises a base fuel injection amount calculating section for calculating a base fuel injection amount corresponding to the stoichiometric air-fuel ratio on the basis of the intake air amount, a target air-fuel ratio calculating section for calculating a target air-fuel ratio according to the engine operating condition, a reference value calculating section for calculating a reference value which represents the target air-fuel ratio and is submitted to comparison with the output of the air-fuel ratio sensor, a feedback correction coefficient calculating section for calculating a feedback coefficient according to the deviation of the output of the air-fuel ratio sensor from the reference value, and a final fuel injection amount calculating section which corrects the base fuel-injection amount on the basis of the ratio of the stoichiometric air-fuel ratio to the target air-fuel ratio and the feedback coefficient to obtain a final fuel injection amount.

8 Claims, 7 Drawing Sheets

AIR-FUEL RADIO CONTROL SYSTEM FOR ENGINE

BACKGROUND OF THE INVENTION

1. Field of the Invention

This invention relates to an air-fuel ratio control system for an engine in which the fuel injection amount is subjected to feedback correction according to the deviation of the actual air-fuel ratio detected by an air-fuel ratio sensor from a target air-fuel ratio determined according to the engine operating condition.

2. Description of the Prior Art

There has been known an air-fuel ratio control system in which the air-fuel ratio of the air-fuel mixture actually introduced into the engine is detected by an air-fuel ratio sensor, the detected air-fuel ratio is compared with a target air-fuel ratio and the amount of fuel to be injected is feedback-corrected according to the deviation of the detected air-fuel ratio from the target air-fuel ratio in order to improve control accuracy of the air-fuel ratio. Further, there also has been known an air-fuel ratio control system in which a lean sensor which outputs a signal substantially in proportion to the exhaust gas oxygen concentration is used as the air-fuel ratio sensor and the air-fuel ratio is feedback-controlled even when the actual air-fuel ratio is leaner than the stoichiometric air-fuel ratio, thereby improving fuel economy. (See Japanese Unexamined Patent Publication No. 59(1984)-208141, for example.)

In such air-fuel ratio control systems, a base fuel injection amount for a given engine operating condition is first determined referring to a map in which the fuel injection amount or the width of the fuel injection pulse is related to the engine speed and the engine load, and the amount of fuel to be actually injected is determined by correcting the base fuel injection amount according to various conditions. In order to compare the output of the air-fuel ratio sensor with a target air-fuel ratio to obtain a feedback signal, a map in which reference values representing the target air-fuel ratios are related to engine operating conditions is used for determining the reference value according to a given engine operating condition and the output value of the air-fuel ratio sensor is compared with the reference value, and then the base fuel injection amount is corrected according to the deviation of the output value of the air-fuel ratio sensor from the reference value. Thus, the conventional air-fuel ratio control systems are disadvantageous in that various control maps of the type described above are needed and a large memory capacity is needed for storing the control maps. Further new control maps must be made when a new engine is developed, when the engine performance is changed, when the control characteristics are changed or when the injector is changed. Further, in the case of a map in which the width of the fuel injection pulse is related to the engine operating condition, widths of the fuel injection pulses optimal for engine operating conditions must be revised, thereby substantially adding to the manhours required for development.

SUMMARY OF THE INVENTION

In view of the foregoing observations and description, the primary object of the present invention is to provide an air-fuel ratio control system which can contribute to simplification of the control system and reduction of development time.

As shown in FIG. 1, the air-fuel ratio control system in accordance with the present invention comprises a base fuel injection amount calculating means 6 which determines a base fuel injection amount according to the amount of intake air detected by an intake air amount detecting means 9 so that the air-fuel ratio becomes equal to the stoichiometric value, a target air-fuel ratio calculating means 7 which determines a target air-fuel ratio according to the engine operating condition detected by an operating condition detecting means 10, a reference value calculating means 11 which determines a reference value corresponding to the target air-fuel ratio, a feedback coefficient calculating means 8 which compares an output signal Vs of an air-fuel ratio sensor 13 disposed in an exhaust passage 12 with an output signal Vr of the reference value calculating means 11 and determines a feedback coefficient according to the deviation of the output signal from the reference value, and a final fuel injection amount calculating means 5 which corrects the base fuel injection amount on the basis of the ratio of the stoichiometric air-fuel ratio to the target air-fuel ratio and the feedback coefficient to obtain a final fuel injection amount and controls an air-fuel ratio adjustment means 4. The air-fuel ratio adjustment means 4 receives the output signal of the final fuel injection amount calculating means 5 and at a predetermined timing delivers to fuel injectors 3 disposed in an intake passage 2 of an engine 1 a fuel injection pulse having a width corresponding to the final fuel injection amount.

In the air-fuel ratio control system in accordance with the present invention, the target air-fuel ratio determined by the target air-fuel ratio calculating means 7 according to the engine operating condition referring to a target air-fuel ratio map is used in both the final fuel injection amount calculating means 5 and the reference value calculating means 11, whereby the number of control maps can be reduced and the required memory capacity can be reduced. Further, since the engine operating condition is not directly related to the fuel injection amount or the width of the fuel injection pulse in any one of the control maps, revision of the control maps because of a specification change of the engine can be effected relatively easily. When the fuel injection amount or the width of the fuel injection pulse is directly related to the engine operating condition in a map, a large amount of information is packed in the map and accordingly, revision of the map requires significant time and labor. On the other hand, the relation between the engine operating condition and the target air-fuel ratio does not substantially depend upon the engine specification, the injector or the like, and accordingly the map used for calculating the target air-fuel ratio according to the engine operating condition can be relatively easily revised.

DESCRIPTION OF THE PREFERRED EMBODIMENT

Figure 2:
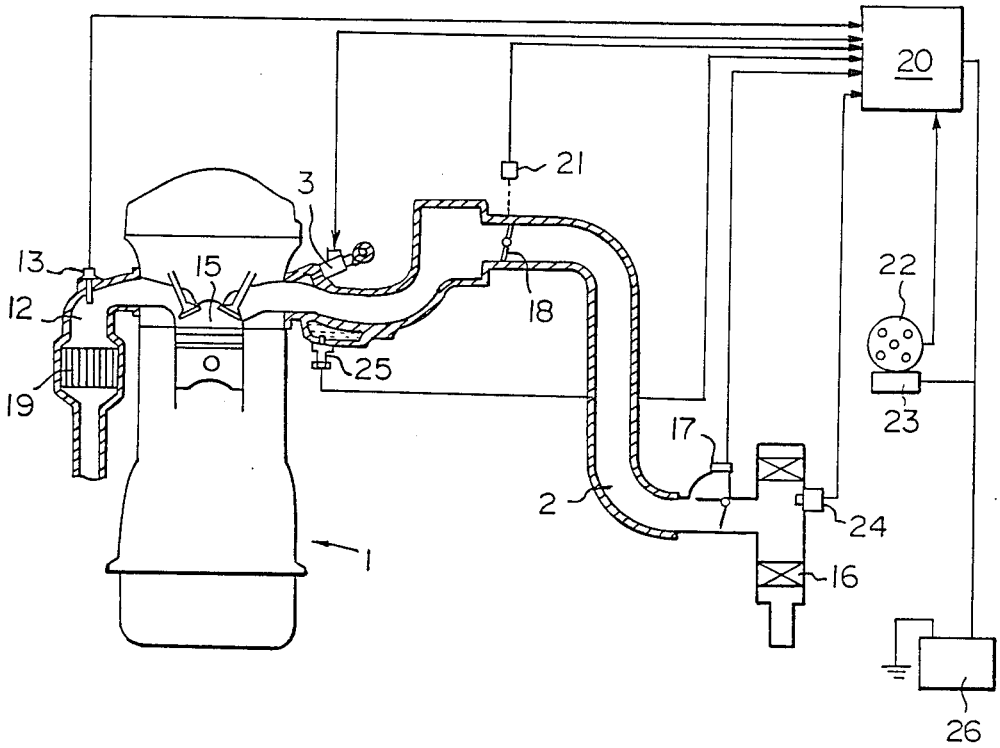
FIG. 2 is a schematic view showing an engine provided with an air-fuel ratio control system in accordance with an embodiment of the present invention.

In FIG. 2, a fuel injector 3 is disposed in an intake passage 2 communicated with a combustion chamber 15 of an engine 1. Further, the intake passage 2 is provided with an air cleaner 16, an airflow sensor 17 and a throttle valve 18. A catalytic convertor 19 is disposed in an exhaust passage 12 of the engine 1 and an air-fuel ratio sensor (lean sensor) 13 is disposed in the exhaust passage 12 upstream of the catalytic convertor 19.

Figure 1:
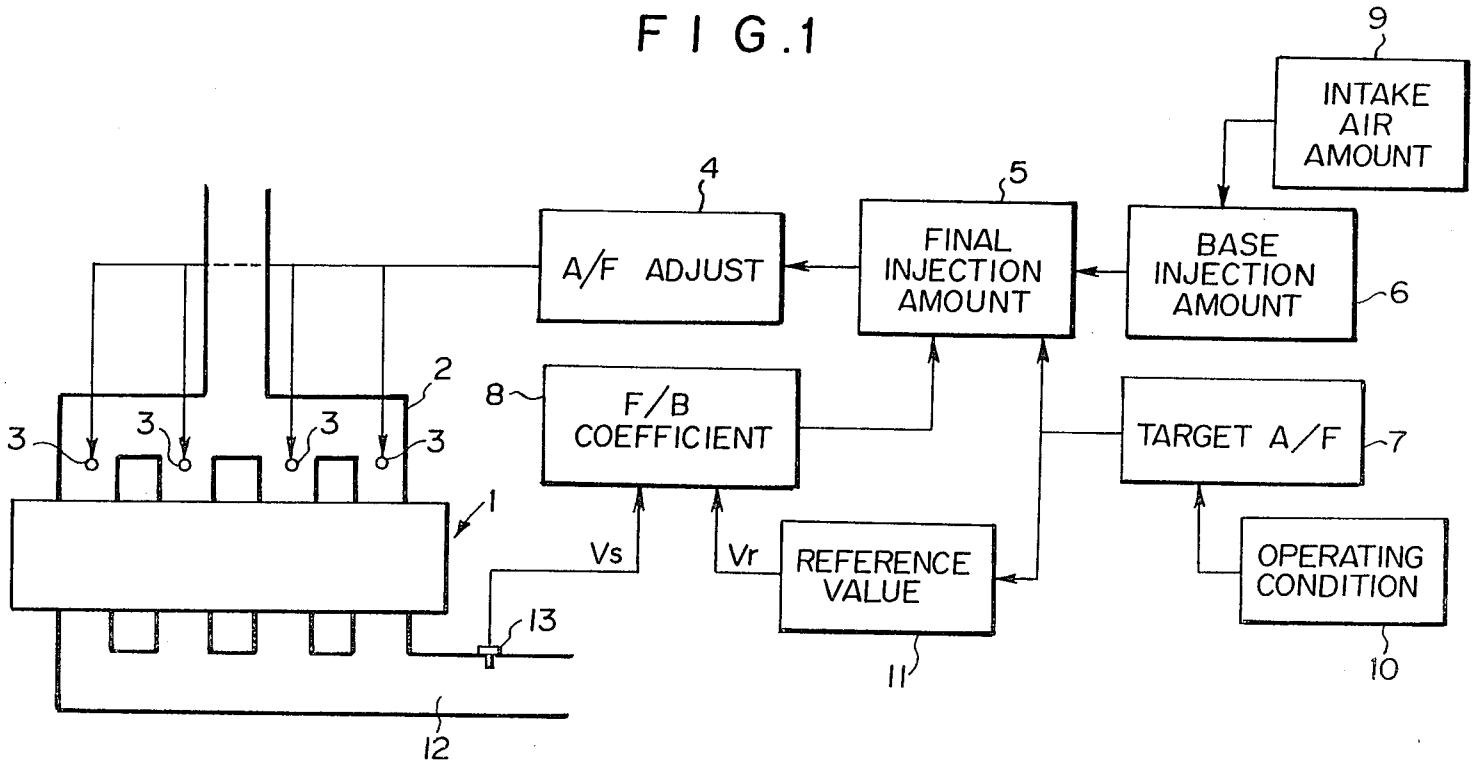
FIG. 1 is a schematic view for illustrating the basic structure of the air-fuel ratio control system in accordance with the present invention.

The air-fuel ratio control system of this embodiment controls the air-fuel ratio of air-fuel mixture to be introduced to the combustion chamber 15 by controlling the amount of fuel to be injected from the injector 3 which is controlled by a control signal output from a controller 20. In order to determine the engine operating condition, there are input into the controller 20 an intake air amount signal from the air flow sensor 17, a throttle opening signal representing the opening of the throttle valve 18 from a throttle sensor 21, a crank angle signal generated by a distributor 22 and an igniter 23, an intake air temperature signal from an intake air temperature sensor 24, a water temperature signal representing the temperature of the engine cooling water from a water temperature sensor 25, and an air-fuel ratio signal from the air-fuel ratio sensor 13, and the controller 20 controls the amount of fuel to be injected from the injector 3 and the injection timing according to the engine operating condition. Reference numeral 26 denotes a battery. Further, the controller 20 accomplishes the functions of the base fuel injection amount calculating means 6, the target air-fuel ratio calculating means 7, the reference value calculating means 11, the feedback coefficient calculating means 8, and the final fuel injection amount calculating means 5 shown in FIG. 1. That is, the controller 20 determines the base fuel injection amount (injection time) according to the amount of intake air so that the air-fuel ratio becomes equal to the stoichiometric value, determines the target air-fuel ratio according to the engine operating condition, determines the feedback coefficient according to the deviation of the output signal of the air-fuel ratio sensor 13 from the reference value corresponding to the stoichiometric value when the actual air fuel ratio is leaner than the stoichiometric value, and corrects the base fuel injection amount with various correction coefficients to obtain the final fuel injection amount.

Figure 3A:
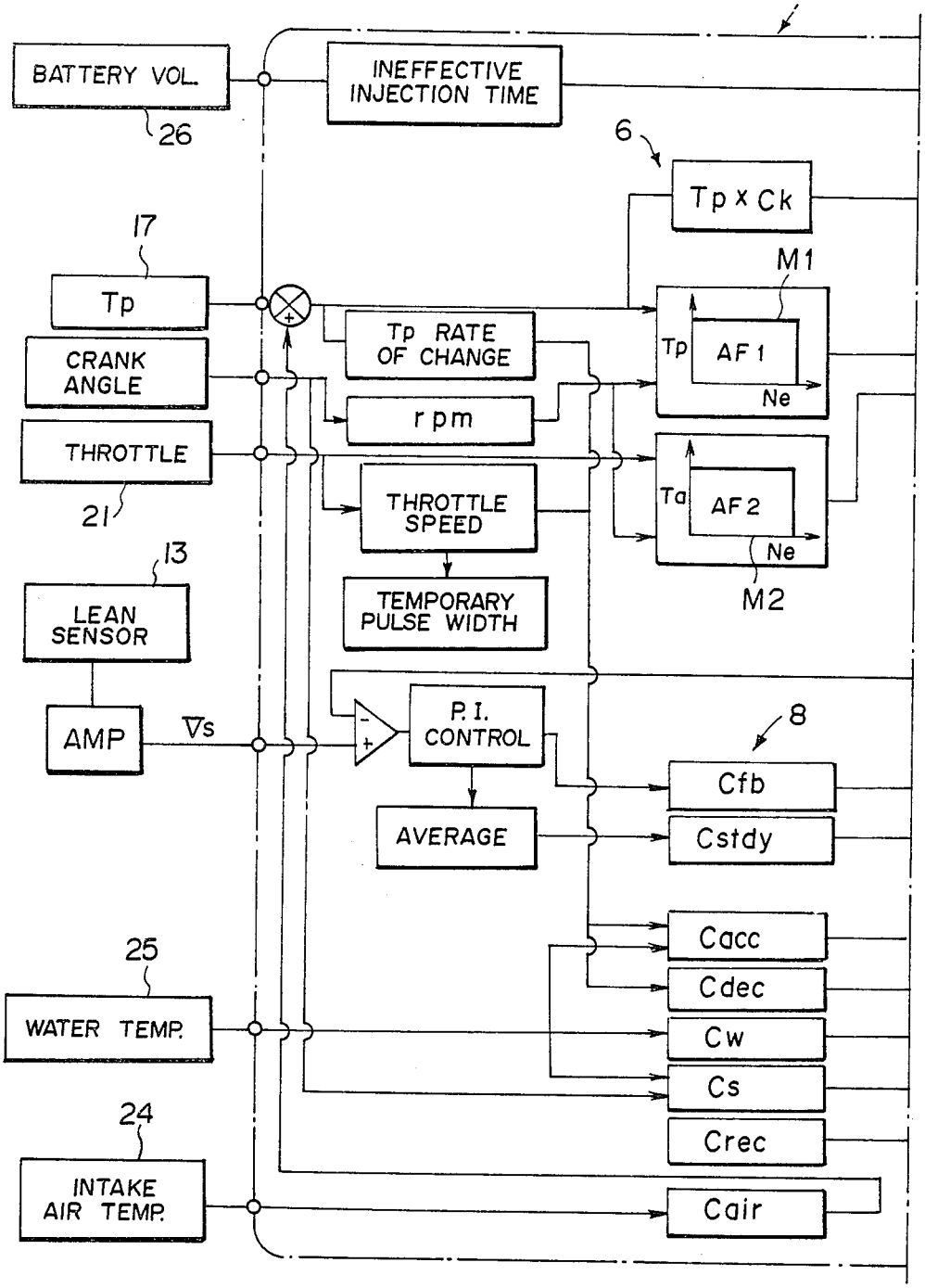
FIGS. 3, 3*a* and 3*b* are block diagrams for illustrating the control to be carried out by the controller.
Figure 3B:
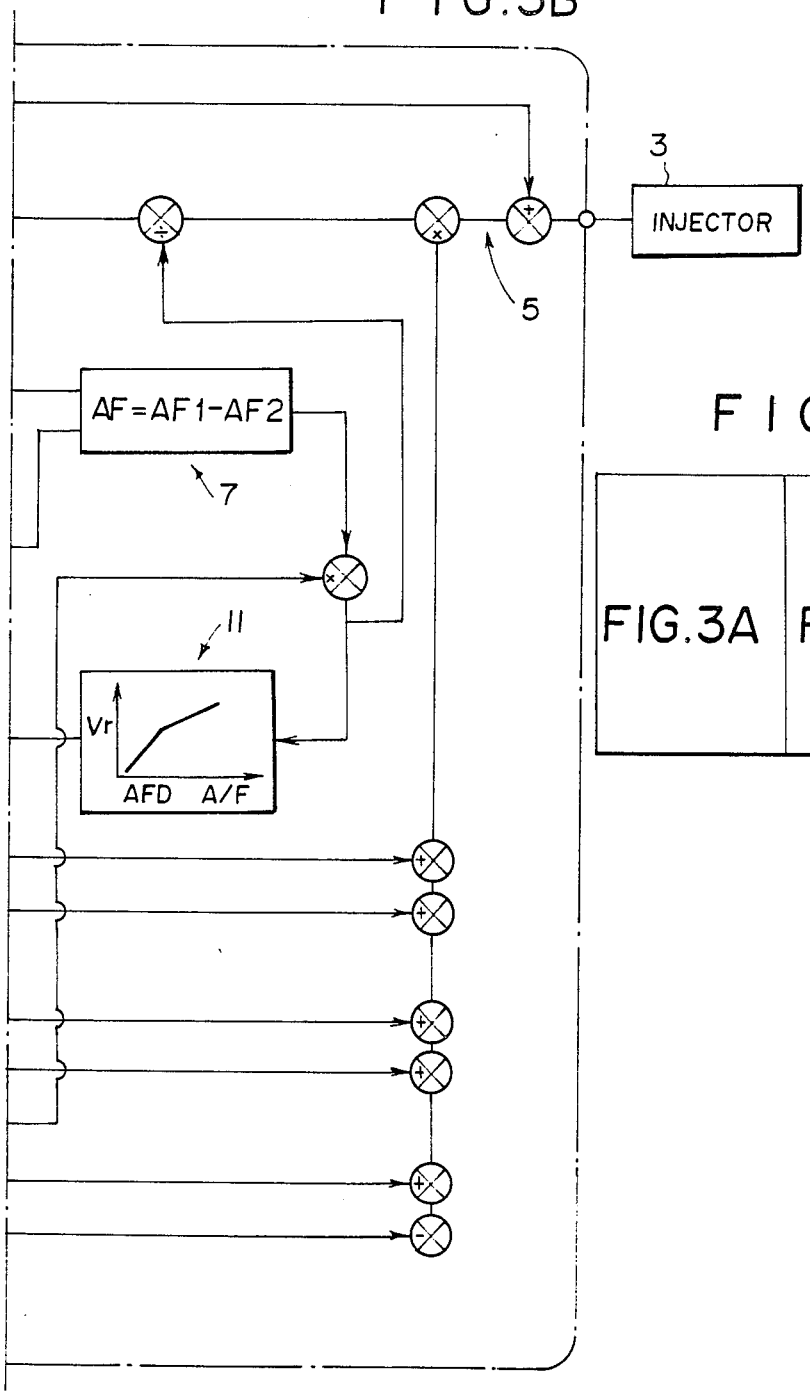
Figure 3:
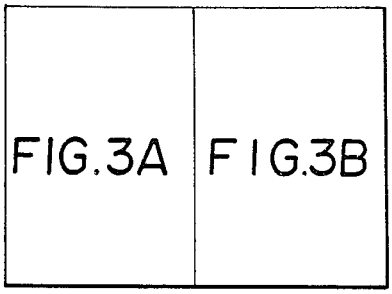

In FIG. 3, an intake air amount signal Tp from the airflow sensor 17 is first compensated for the temperature of intake air by an intake air temperature correction coefficient $C_{air}$ determined on the basis of the output of the intake air temperature sensor 24, and then submitted to calculation of a base fuel injection pulse ($Tp \times Ck$). At the same time, a first air-fuel ratio AF1 is read from a first map $M_1$ according to the engine speed Ne derived from a crank angle signal and the compensated intake air amount signal. Further, a second air-fuel ratio AF2 is read from a second map $M_2$ according to a throttle opening Ta output from the throttle sensor 21 and the engine speed Ne. Then a target air-fuel ratio AF is derived from the first and second air-fuel ratios AF1 and AF2.

The target air-fuel ratio AF is first compensated for the temperature of the engine cooling water by a cooling water temperature correction coefficient $C_w$ determined on the basis of the output of the water temperature sensor 25, and then submitted to calculation of a reference value Vr and correction of the base fuel injection pulse.

The output signal of the air-fuel ratio sensor 13 is amplified and compared with the reference value Vr by a comparator. The output signal of the comparator is submitted to calculation of a feedback correction coefficient Cfb through P.I. control. Peak values upon signal inversions in the P.I. control are averaged to obtain a study correction coefficient Sstdy. Acceleration or deceleration of the vehicle is detected by way of the rate of change of the intake air amount signal Tp or the rate of change of the throttle opening Ta, and an acceleration increase correction coefficient Cacc or a deceleration increase correction coefficient Cdec is calculated. Further, cranking of the engine is detected through the crank angle signal and an after-cranking increase correction coefficient Cs is calculated taking into account the cooling water temperature. Further, a recirculation reduction correction coefficient Crec is calculated. The base fuel injection pulse is corrected on the basis of the correction coefficients thus obtained, and at the same time, an ineffective injection time Tv depending on the battery voltage is calculated and the base fuel injection pulse is further corrected on the basis of the ineffective injection time Tv to obtain a final fuel injection pulse. The final fuel injection pulse thus obtained is delivered to the injector 3. The fuel injection timing is controlled by a separate control system.

Figure 4:
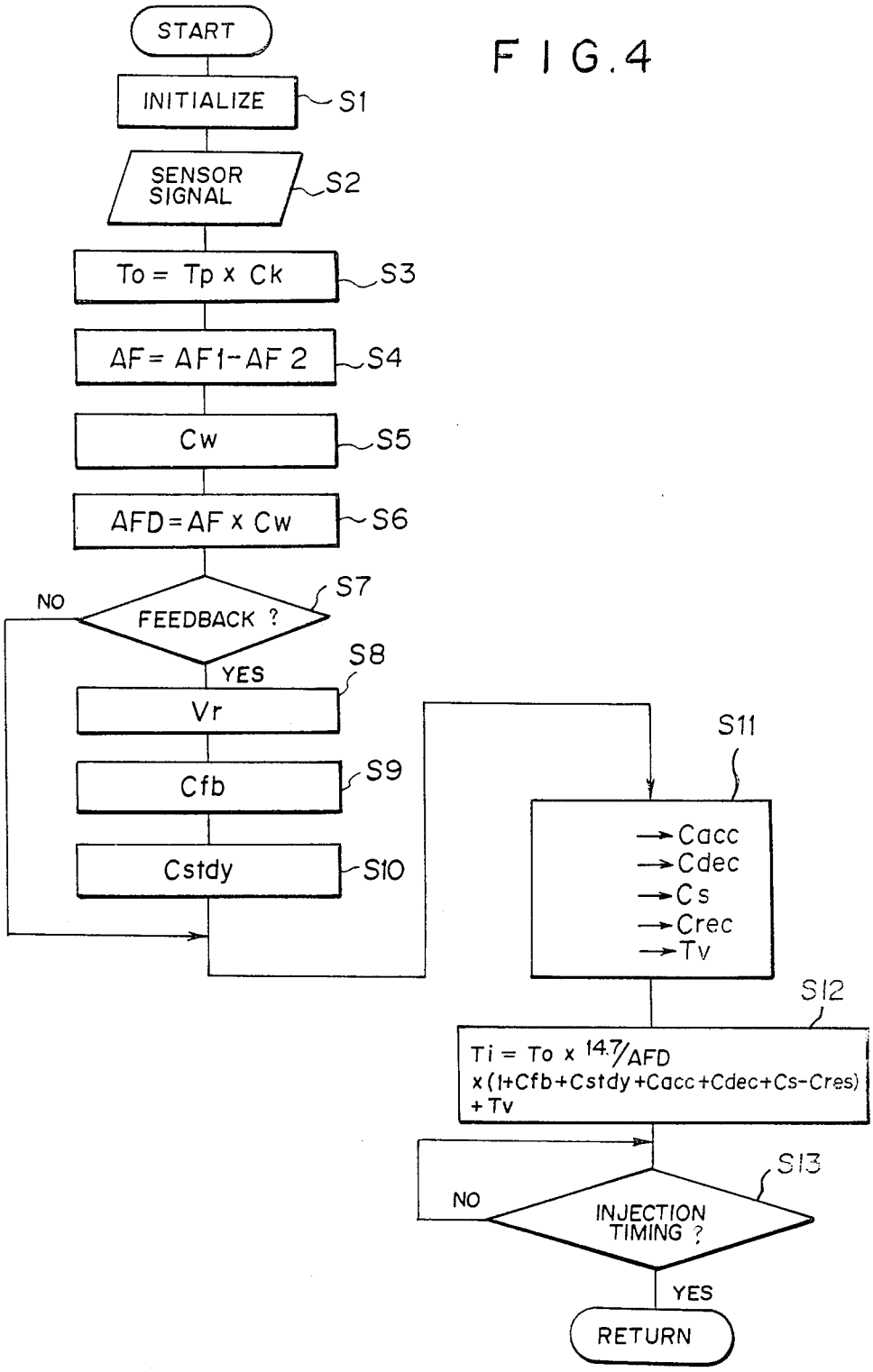
FIG. 4 is a flow chart for illustrating the operation of the controller.

The operation of the controller 20 will be described in more detail with reference to the flow chart shown in FIG. 4. This flow chart shows only a main part of the routine for calculating the final fuel injection pulse.

The controller 20 first initializes the system in step S1, and reads, in step S2, the outputs of the sensors described above in order to detect the operating condition of the engine 1. In step S3, the base fuel injection time To ($=Tp \times Ck$) is calculated on the basis of the intake air amount signal Tp compensated for the intake air temperature. The base fuel injection time To corresponds to the fuel injection amount proportionate to the intake air amount for controlling the air-fuel ratio to the stoichiometric value ($A/F=14.7$), and the coefficient Ck is a matching coefficient for the airflow sensor 17 and the injector 3.

Figure 5:
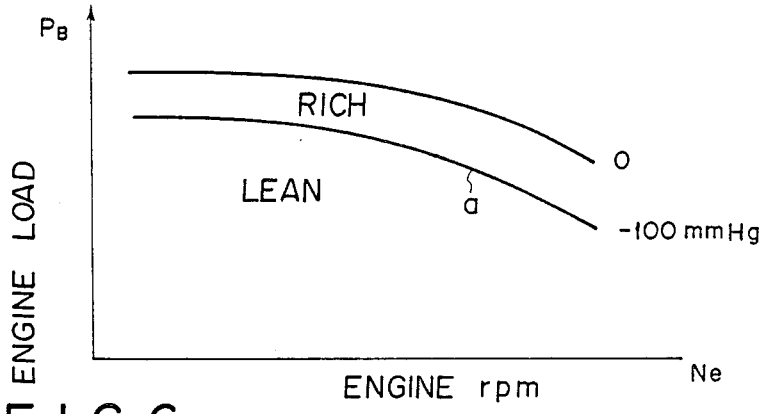
FIG. 5 shows the relation of the base target air-fuel ratio to the engine load and the engine speed.

Then in step S4, a base target air-fuel ratio AF is calculated. The base target air-fuel ratio AF is basically related to the engine speed Ne and the engine load (the intake pressure Pb) to be rich in a heavy load range and lean in intermediate and light load ranges as shown in FIG. 5. In accordance with the base target air-fuel ratio characteristics shown in FIG. 5, a slight change in the engine load across the boundary a between the rich range and the lean range leads to an abrupt change of the air-fuel ratio. In order to precisely control the air-fuel ratio without generating shock when the engine operating condition moves across the boundary a, the first and second maps $M_1$ and $M_2$ are used for calculating the base target air-fuel ratio AF.

Figure 6:
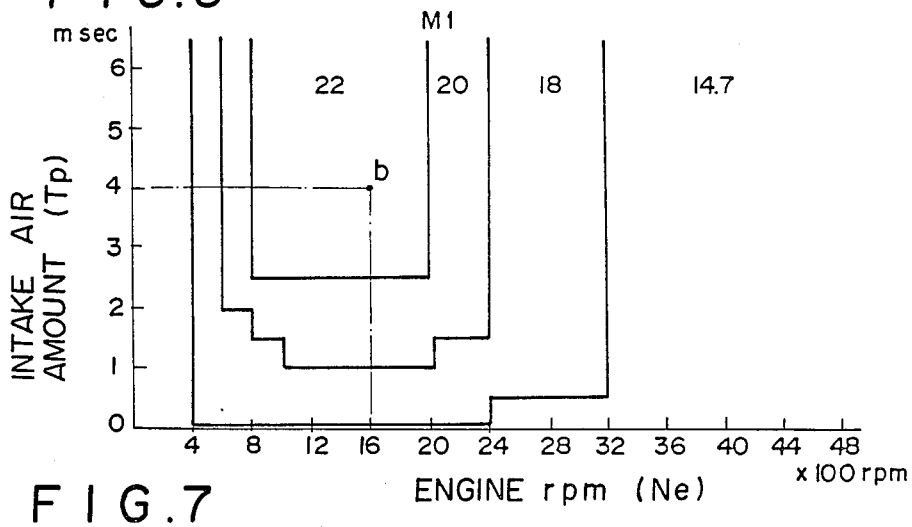
FIG. 6 shows the first map.
Figure 7:
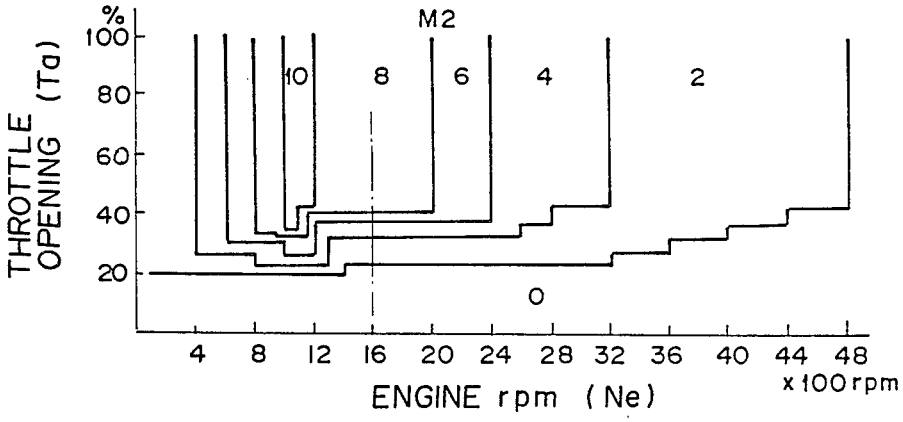
FIG. 7 shows the second map.

In the first map $M_1$, the first air-fuel ratio $AF_1$ is related to the engine speed Ne and the intake air amount signal Tp as shown in FIG. 6, the figure in each area in FIG. 6 representing the value of the first air-fuel ratio $AF_1$. In the second map $M_2$, the second air-fuel ratio $AF_2$ is related to the engine speed Ne and the throttle opening Ta as shown in FIG. 7, the figure in each area in FIG. 7 representing the value of the second air-fuel ratio $AF_2$ (correction air-fuel ratio). The base target air-fuel ratio AF is obtained by subtracting the second air-fuel ratio $AF_2$ from the first air-fuel ratio $AF_1$, that is, $AF=AF_1-AF_2$.

For example, when the engine operating condition related to the engine speed Ne and the intake air amount is as represented by point b in FIG. 6 and the throttle opening Ta is 60%, the first air-fuel ratio $AF_1$ is determined to be 22 from the first map $M_1$ and the second air-fuel ratio $AF_2$ is determined to be 8 from the second map $M_2$, thereby obtaining a base target air-fuel ratio of 14 ($22-8=14$). When the throttle opening Ta is in the range of 40 to 20%, the second air-fuel ratio AF is finely set to be 8 to 2 so that the base target air-fuel ratio AF is gradually increased into the lean range.

Figure 8:
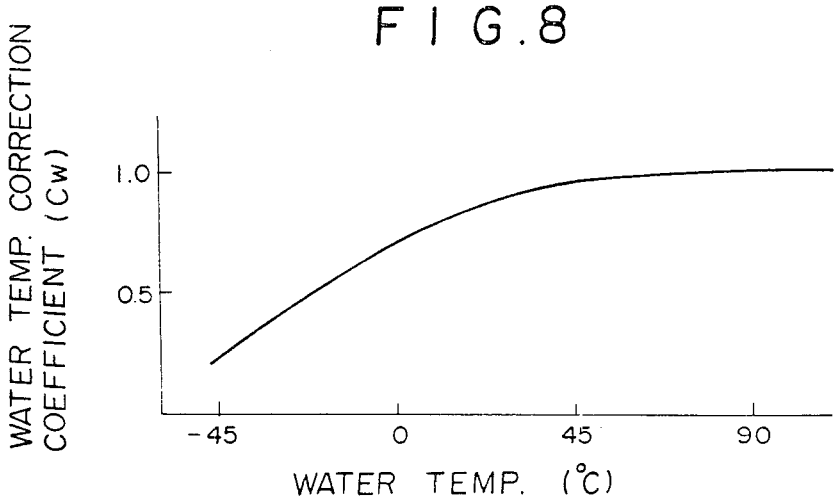
FIG. 8 is a graph showing the relation between the temperature of the engine cooling water and the water temperature correction coefficient.

In step S5, the cooling water temperature correction coefficient $C_w$ is calculated on the basis of the detection signal of the water temperature sensor 25. In step S6, the base target air-fuel ratio AF calculated in the step S4 is corrected on the basis of the cooling water temperature correction coefficient $C_w$ to obtain a corrected target air-fuel ratio AFD. The cooling water temperature correction coefficient $C_w$ is of a value not larger than 1 and decreases with lower cooling water temperature as shown in FIG. 8 so that the corrected target air-fuel ratio AFD is enriched with lower cooling water temperature. When the temperature of the cooling water rises substantially above 45° C., the cooling water temperature correction coefficient $C_W$ is approximated to 1 and the corrected target air-fuel ratio AFD becomes substantially equal to the base target air-fuel ratio AF.

In step S7, it is determined whether the engine operating condition is such as requires feedback control of the air-fuel ratio. In the step S7, when the corrected target air-fuel ratio is not smaller than 14.7 (lean), it is determined that the feedback control is to be carried out, and otherwise, it is determined that an open loop control is to be carried out.

Figure 9:
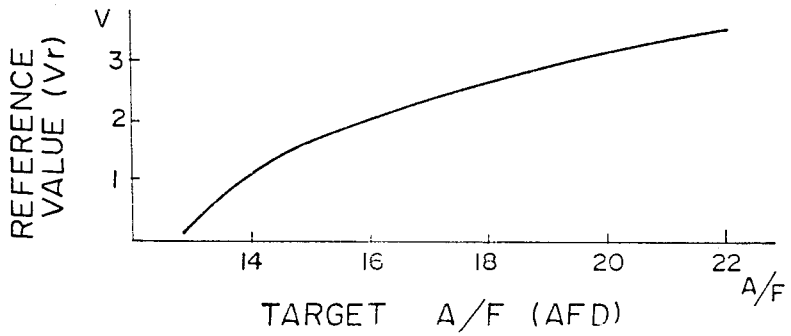
FIG. 9 is a graph showing the relation between the target air-fuel ratio and the reference value.

When it is determined in the step S7 that the feedback control is to be carried out, a reference value Vr for comparing the corrected target air-fuel ratio AFD with the output Vs of the air-fuel ratio sensor 14 (i.e., a slice level) is calculated in step S8. As shown in FIG. 9, the reference value Vr is a voltage which is related to the corrected target air-fuel ratio AFD to be increased with increase of the corrected target air-fuel ratio AFD. In step S9, the reference value Vr corresponding to the corrected target air-fuel ratio AFD is compared with the output Vs of the air-fuel ratio sensor 13 and a feedback correction coefficient Cfb is calculated. In the next step S10, a study correction coefficient Cstdy is calculated.

The feedback correction coefficient Cfb is calculated on the basis of the following formula in order to effect a P.I. control.

$$Cfb=P+\int \Delta I d\theta$$

In this control, the feedback correction coefficient Cfb is determined so as to enrich the air-fuel mixture to be introduced into the engine when the sensor output Vs is larger than the reference value Vr (that is, when the detected air-fuel ratio is leaner than the corrected target air-fuel ratio AFD), and to make the air-fuel mixture leaner when the sensor output Vs is smaller than the reference value Vr. The value P in the above formula is a value to be uniformly added or subtracted when the order of values of the sensor output Vs and the reference value Vr is inverted, and the value ΔI is a value to be subtracted or added every predetermined crank angle. The values P and ΔI are set as follows so that the feedback correction coefficient Cfb or the air-fuel ratio of the air-fuel mixture to be fed to the engine gradually changes during idling.

| throttle | full closed | otherwise |
|---|---|---|
| P | 0.025 | 0.047 |
| ΔI | 0.0021 | 0.0041 |

The study correction coefficient Cstdy is obtained by adding up the values of the feedback correction coefficient Cfb at the time increase and decrease of the value of the feedback correction coefficient Cfb is inverted and taking an average of the values when a predetermined number of the values have been added up. However, if the newest study correction coefficient Cstdy' is used, as it is, for correcting the base fuel injection time To, a wrong study will lead to a significant change of the air-fuel ratio, and accordingly, a value obtained by adding a quarter of the newest study correction coefficient Cstdy' to the preceding study correction coefficient Cstdy is actually adopted as the study correction coefficient Cstdy.

In step S11, other correction coefficients, such as the acceleration correction coefficient Cacc, the deceleration correction coefficient Cdec, the after-cranking correction coefficient Cs, and the recirculation correction coefficient Crec, as well as the ineffective injection time Tv are calculated. Then, in step S12, a final fuel injection pulse width Ti is calculated, and fuel is injected for a time corresponding to the final fuel injection pulse width Ti at a predetermined timing (step S13).

The final fuel injection pulse width Ti is obtained by multiplying the base fuel injection time To calculated in the step S3 by the ratio of the stoichiometric air-fuel ratio (14.7) to the corrected target air-fuel ratio AFD calculated in the step S6, thereby obtaining the fuel injection time corresponding to the corrected target air-fuel ratio AFD, obtaining a corrected fuel injection time by multiplying the fuel injection time corresponding to the corrected target air-fuel ratio by a value obtained by adding to or subtracting from 1 the various relevant correction coefficients, and adding the ineffective injection time Tv to the corrected fuel injection time.

In the particular embodiment described above, the base target air-fuel ratio calculated according to the engine operating condition is compensated for the engine cooling water temperature (the engine temperature) to obtain the corrected target air-fuel ratio and then the reference value representing the corrected target air-fuel ratio and to be submitted to comparison with the output of the air-fuel ratio sensor is calculated.

This is advantageous over the conventional system in which the reference value (representing the base target air-fuel ratio) to be submitted to comparison with the output of the air-fuel ratio sensor is first calculated and then compensated for the engine cooling water temperature. That is, though the relation of the output of the air-fuel ratio sensor to the exhaust gas oxygen concentration is linear, the relation of the output of the air-fuel ratio sensor to the air-fuel ratio is not linear, and accordingly, if the base target air-fuel ratio is first calculated and thereafter compensated for the engine temperature, the value of the air-fuel ratio actually changed for a given value of the correction coefficient can vary depending on the value of the base target air-fuel ratio before the correction. This adversely affects the control accuracy. On the other hand, in the system of the embodiment in which the base target air-fuel ratio calculated according to the engine operating condition is first compensated for the engine temperature to obtain the corrected target air-fuel ratio and then the reference value representing the corrected target air-fuel ratio and to be submitted to comparison with the output of the air-fuel ratio sensor is calculated, the control accuracy cannot be affected by properties of the air-fuel ratio sensor. It is also preferred that compensation for various engine conditions such as change in the atmospheric pressure, change with age of the engine, or which mode is selected, power mode or economy mode, be effected before calculation of the reference value.

Further, the corrections other than the feedback correction made in the embodiment described above may be omitted if desired.

We claim:

1. An air-fuel ratio control system for an engine in which a fuel injection amount is calculated according to the engine operating conditions of at least engine load and speed and is adjusted according to the output of an air-fuel ratio sensor, comprising means for measuring the intake air amount, a base fuel injection amount calculating means responsive to said means for measuring the intake air amount for calculating a base fuel injection amount corresponding to the stoichiometric air-fuel ratio, a target air-fuel ratio calculating means for calculating a target air-fuel ratio according to said engine operating conditions, a reference value calculating means responsive to the output of the target air-fuel ratio calculating means for calculating a reference value which is a function of the target air fuel ratio, comparision means for comparing the output of the air-fuel ratio sensor and the reference value, a feedback correction coefficient calculating means for calculating a feedback coefficient according to any deviation of the output of the air-fuel ratio sensor from the reference value as determined by the comparision means, and a final fuel injection amount calculating means responsive to the outputs of the base fuel injection amount calculating means, the target air-fuel ratio calculating means, and the feedback correction coefficient calculating means to adjust the base fuel-injection amount where the latter adjustment is a function of (a) the ratio of the stoichiometric air-fuel ratio to the target air-fuel ratio and (b) the feedback coefficient to thus obtain a final fuel injection amount.

2. An air-fuel ratio control system as defined in claim 1 in which said final fuel injection amount calculating means calculates the final fuel injection amount by multiplying the base fuel injection amount by the ratio of the stoichiometric air-fuel ratio to the target air-fuel ratio and the feedback coefficient.

3. An air-fuel ratio control system as defined in claim 1 further comprising a feedback condition determining means which determines that the feedback control is to be effected when the target air-fuel ratio is in a predetermined range.

4. An air-fuel ratio control system as defined in claim 3 in which the target air-fuel ratio is leaner than the stoichiometric air-fuel ratio in said predetermined range.

5. An air-fuel ratio control system for an engine in which a fuel injection amount is calculated according to the engine operating conditions of at least engine load and speed and is adjusted according to the output of an air-fuel ratio sensor, comprising means for measuring at least one of said engine operating conditions, a base fuel injection amount calculating means responsive to said means for measuring said one operating condition for calculating a base fuel injection amount, a base target air-fuel ratio calculating means for calculating a target air-fuel ratio according to at least one of said engine operating conditions, a target air-fuel ratio adjusting means for correcting the base target air-fuel according to at least another one of said engine operating conditions thereby obtaining an adjusted target air-fuel ratio, a reference value calculating means responsive to the output of the target air-fuel ratio adjusting means for calculating a reference value which is a function of the adjusted target air-fuel ratio, comparision means for comparing the output of the air-fuel ratio sensor, a feedback correction coefficient calculating means for calculating a feedback coefficient according to any deviation of the output of the air-fuel ratio sensor from the reference value as determined by the comparision means, and a final fuel injection amount calculating means responsive to the outputs of the base fuel injection amount calculating means, the target air-fuel ratio adjusting means, and the feedback correction coefficient calculating means to adjust the base fuel-injection amount of the adjusting target air-fuel ratio and the feedback coefficient to obtain a final fuel injection amount.

6. An air-fuel ratio control system as defined in claim 5 in which said engine condition represents the temperature of the engine cooling water.

7. An air-fuel ratio control system as defined in claim 1 in which said engine operating condition is determined by engine speed and engine load, and said target air-fuel ratio is predetermined based on said engine speed and engine load.

8. An air-fuel ratio control system as defined in claim 7 in which said engine load is determined by throttle opening and intake air amount, and a throttle opening-engine speed map and an intake air amount-engine speed map are provided.

* * * * *